US005786663A

United States Patent [19]

Meyer et al.

[11] Patent Number: 5,786,663

[45] Date of Patent: Jul. 28, 1998

[54] ELECTRON COLLECTOR HAVING INDEPENDENTLY CONTROLLABLE CONDUCTIVE STRIPS

[75] Inventors: Robert Meyer, St Nazaire les Eymes; Brigitte Montmayeul, Brignoul; Jean-François Boronat, Grenoble; Jean-Frédéric Clerc, Saint Egreve, all of France

[73] Assignee: Commissariat a l'Energie Atomique

[21] Appl. No.: 716,570

[22] Filed: Sep. 18, 1996

Related U.S. Application Data

[63] Continuation of Ser. No. 352,812, Dec. 1, 1994, abandoned.

[51] Int. Cl.[6] ..... H01J 31/12

[52] U.S. Cl. ..... 313/495; 313/496; 313/466

[58] Field of Search ..... 313/495, 496, 313/497, 517, 466; 345/47, 75; 359/80

[56] References Cited

U.S. PATENT DOCUMENTS

| | | | |
|---|---|---|---|
| 3,864,591 | 2/1975 | Akahane et al. | 313/496 |
| 3,906,285 | 9/1975 | Kobayakawa et al. | 313/496 |
| 4,098,939 | 7/1978 | Kuroda et al. | 313/496 |
| 4,551,652 | 11/1985 | Compeu et al. | 313/466 |
| 4,763,187 | 8/1988 | Biberian | 358/56 |
| 4,857,799 | 8/1989 | Spindt et al. | 313/497 |
| 5,173,636 | 12/1992 | Son | 313/466 |
| 5,225,820 | 7/1993 | Clerc | 340/752 |
| 5,231,387 | 7/1993 | Clerc | 340/781 |
| 5,278,544 | 1/1994 | Leroux | 345/74 |
| 5,410,423 | 4/1995 | Furushima et al. | 359/80 |
| 5,453,659 | 9/1995 | Wallace et al. | 313/496 |

FOREIGN PATENT DOCUMENTS

0635865A1 1/1995 European Pat. Off. .

OTHER PUBLICATIONS

Morimoto et al. "320x200–Pixel Color Graphic FLVFD", Japan Display '86, pp. 516–519 No month.

*Primary Examiner*—Nimeshkumar Patel

*Attorney, Agent, or Firm*—Burns, Doane, Swecker & Mathis LLP

[57] ABSTRACT

An electron collector having an anode constituted by a substrate (21, 40, 41) on which are deposited conductive strips or tracks (23, 43). A dielectric material layer is deposited on at least one of the edges of each conductive strip.

60 Claims, 6 Drawing Sheets

ELECTRON COLLECTOR HAVING INDEPENDENTLY CONTROLLABLE CONDUCTIVE STRIPS

This application is a continuation of application Ser. No. 08/352,812, filed Dec. 1, 1994 now abandoned.

FIELD OF THE INVENTION

The present invention relates to an electron collector having independently controllable anodes.

BACKGROUND OF THE INVENTION

Electron collectors are used in microtip fluorescent screens such as those described in FR-A-2 633 763, FR-A-2 633 765 and U.S. Pat. No. 4,763,187, as well as VFD-structures described in the article by K. MORIMOTO et al ("Proceedings of Japan Display 86", pp 516 to 519), entitled "320×200—Pixel Color Graphic FLV FD".

The structure and operating principle of a prior art collector are shown in FIGS. 1*a*, 1*b* and 2, the example used being that of a microtip fluorescent screen.

FIG. 1*a* shows a perspective view of the constituent elements of such a screen, essentially a facing anode and cathode. The cathode has a first substrate 10 (of, e.g., glass), on which are placed conductive columns 12 (of e.g., indium and tin oxide cathode conductors) supporting metallic microtips 14, (of e.g., molybdenum). The columns 12 intersect perforated conductive rows or grids 16 (of, e.g., niobium).

All the microtips 14 positioned at an intersection of a row 16 and a conductive column 12 have their top or apex substantially facing a perforation of the row 16. The cathode conductors 12 and grids 16 are separated by an insulating layer 18 (of, e.g., silica) having openings permitting the passage of the microtips 14.

The anode has a second insulating substrate 20, (of, e.g., glass), which supports conductive strips 22 covered with luminescent materials. At least one of the two substrates 10 or 20 must be transparent.

A first series of strips 22 is covered by a red-luminescing material 24, (e.g., Eu-doped $Y_2O_2S$), a second series of strips 22 is covered by a green-luminescing material 26, (e.g., CuAl-doped ZnS) and the final series of strips 22 is covered by a blue-luminescing material 28, (e.g., Ag-doped ZnS).

The strips 22 of the different series alternate and are spaced from one another, at e.g. equal distances.

Each triplet formed by an anode of each series approximately faces a row or grid 16. Each intersection of a grid 16 and a cathode conductor 12 forms a three-color pixel.

Advantageously, a resistive layer (not shown) can be intercalated between the microtips and the cathode conductors.

FIG. 1*b* is a sectional view along aa' (FIG. 1*a*).

FIG. 2 defines the operation of such a system. The three colors are successively addressed, e.g. according to a sequential mode. In order to address the green color, the corresponding strips 22 are polarized at 200 volts, while maintaining the strips covered with luminescent materials emitting red 24 and blue 28 at a potential below their excitation threshold. The same is then performed for red, and then blue. The voltages indicated in FIG. 2 for the column 12 (0 V) and the row 16 (+70 V) are exemplary. The addressing corresponds to the focussing of the electrons emitted by the cathode on the selected anode strip 22, which brings about the fluorescence of the corresponding material 26. This type of operation is called "switched anode operation".

Compared with the conventional structure in which the three colors are addressed simultaneously, the above structure has three essential advantages:

- a reduced number of cathode conductor addressing circuits (one cathode conductor for three red-green-blue anode strips instead of one cathode conductor per anode strip),
- reduced precision necessary for alignment between anode and cathode, and
- a greater resolution.

The major disadvantage of this structure is that the excitation voltage of the anode (or anode voltage) which can be applied is limited as a result of the breakdown risks existing between the polarized color (polarized at 200 V in FIG. 2) and the other colors maintained at a potential close to that of the tips (polarized at 0 V in FIG. 2).

This limitation is a problem because the luminous efficiency of the conductive strips 22 of the anode increases as their excitation voltage rises.

Another disadvantage is illustrated in FIG. 2 References 1 to 8 designate the trajectories of the electrons. Some of the electrons do not reach the luminescent material 26 and instead passes directly to the edges of the conductive tracks or strips 22 (e.g., trajectories 1, 7 and 8). Therefore, the luminous efficiency of the screen is reduced.

These problems are not specific to microtip fluorescent screens. In more general terms reference can be made to FIG. 3, which shows a prior art electron collector. It has a substrate 20 extending in direction x'x, but also perpendicular to the plane of the drawing.

Two conductive strips 22-1 and 22-2 are shown and extend perpendicular to FIG. 3 and each is raised to a variable potential making it possible to define, for each strip, an electron collector or non-collector state. The electrons are emitted by a cathode (not shown) positioned facing the strips 22. For this type of collector, the same two problems as in the case of the fluorescent screen are encountered.

1. There is a risk of a breakdown between two adjacent conductive tracks, when one is in the electron collecting state and the other in a non-collecting state, i.e. when there is a high potential difference between them.

FIG. 3 shows a few field lines 30 between these two strips. The breakdowns are more specifically initiated as a result of a bringing together of the field lines on the edge A of the conductive strips 22. The space between the conductive strips 22 is particularly favorable for the propagation of such breakdowns, because the dielectric constant of the space is 1.

2. The electron trajectories are spread over the entire width of the track, up to its edges, where the track is inclined towards the substrate (also in area A). This reduces the "focussing" of the electron beam on the selected track and, when the track is covered by a target material, reduces electron efficiency.

SUMMARY OF THE INVENTION

The present invention aims to overcome these disadvantages by improving the structure of an electron collector. The practical result in the particular case of fluorescent screens is an improvement in screen brightness. It is also possible to obtain an improvement in contrast when the screen is subject to external illumination.

More specifically, the present invention relates to an electron collector having an anode constituted by a substrate on which conductive strips are deposited. Each of the strips has a central portion defined by edges, and a dielectric material layer is deposited on at least one edge, and preferably both edges of each conductive strip or track.

Where the dielectric material or shield is deposited on a conductive strip, two essential technical effects are obtained.

First, the electric field on the edge of the conductive strip in contact with the dielectric material is reduced compared with the electric field at the same location in a prior art device (i.e., without the dielectric material). The reduction is in a ratio close to $\epsilon/\epsilon_o$, in which $\epsilon$ represents the dielectric constant of the shield and $\epsilon_o$ the dielectric constant of the space. The breakdown risks are reduced by the same amount. Therefore, a higher anode voltage can be applied.

Second, where the dielectric material is in contact with the edge of a conductive strip, the electrons emitted by the cathode pass directly to that part of the track not covered by the shield (e.g. area B in FIG. 3) or, in the case of a fluorescent screen, to the luminescent material covering the track, because the edges of the conductive strip are protected by the dielectric. The electron collection efficiency is therefore improved and it is possible to obtain a better "focussing" on the selected strip.

This effect is further improved if the dielectric material layer extends beyond the edge of the conductive strip on which it is deposited and encroaches on the central part of said strip.

Preferably, a collector as described hereinbefore, is characterized in that the dielectric material strip also extends from the edge of the strip with which it is in contact up to the edge of the adjacent strip.

According to a preferred embodiment, the dielectric shield is constituted by a material having a high dielectric constant. Preferably, the dielectric shield is of silica.

BRIEF DESCRIPTION OF THE DRAWINGS

The invention is described in greater detail hereinafter using illustrative embodiments with reference to the attached drawings, wherein.

DETAILED DESCRIPTION OF THE PREFERRED EMBODIMENTS

Figure 1A:
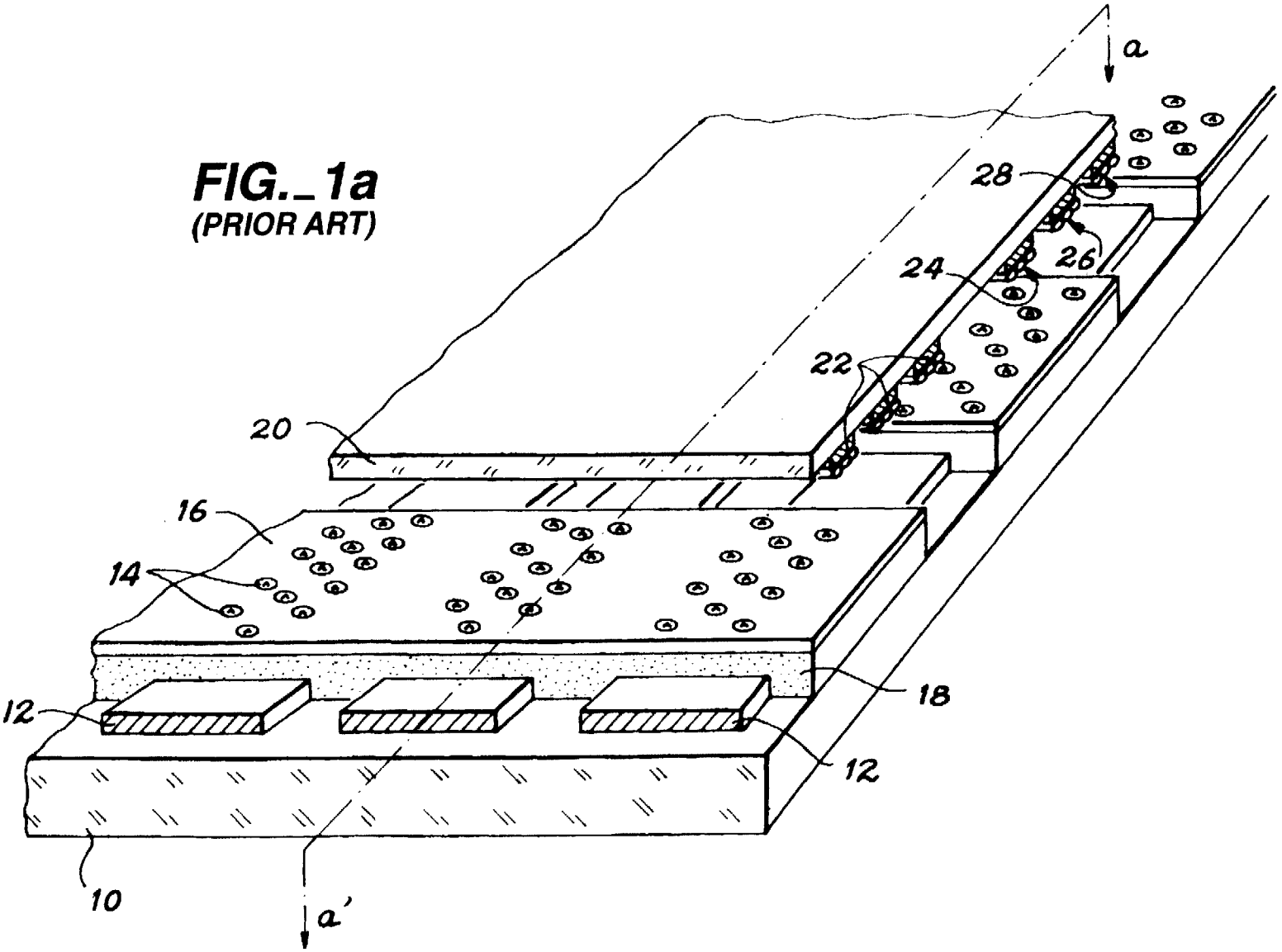
FIG. 1a (PRIOR ART)
FIGS. 1*a* and 1*b* show the structure of a prior art electron collector, in the case of a microtip fluorescent screen.
Figure 1B:
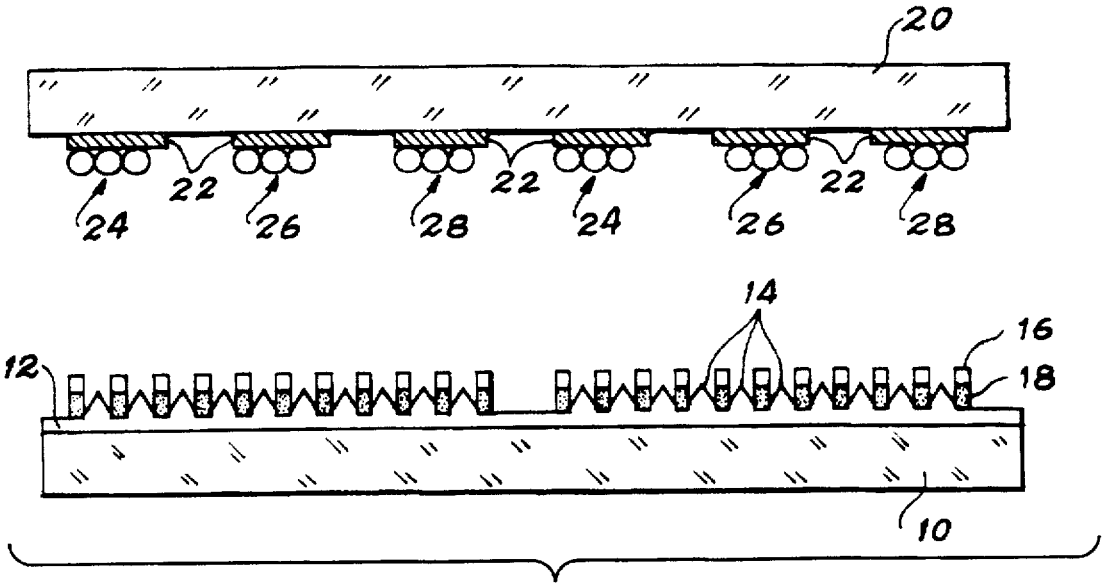
FIG. 1b (PRIOR ART)
Figure 2:
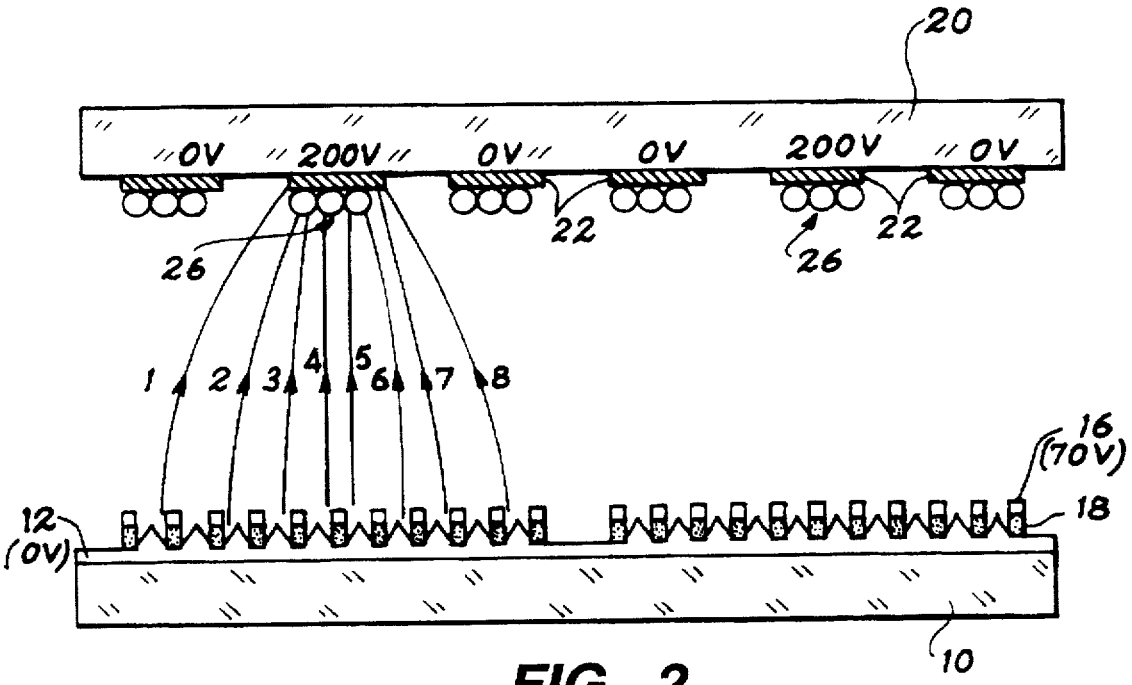
FIG. 2 (PRIOR ART)
FIG. 2 shows the trajectories of electrons emitted by the cathode, in the case of a prior art electron collector.
Figure 3:
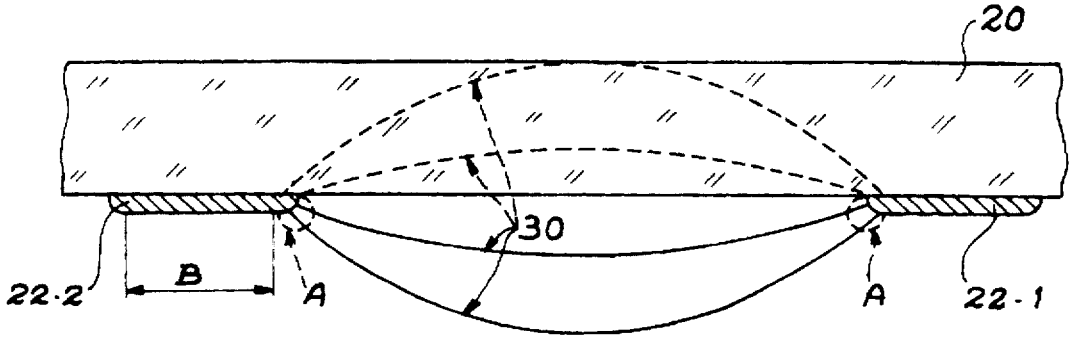
FIG. 3 (PRIOR ART)
FIG. 3 shows the distribution of the field lines between two adjacent anodes in the case of a prior art electron collector.
Figure 4A:
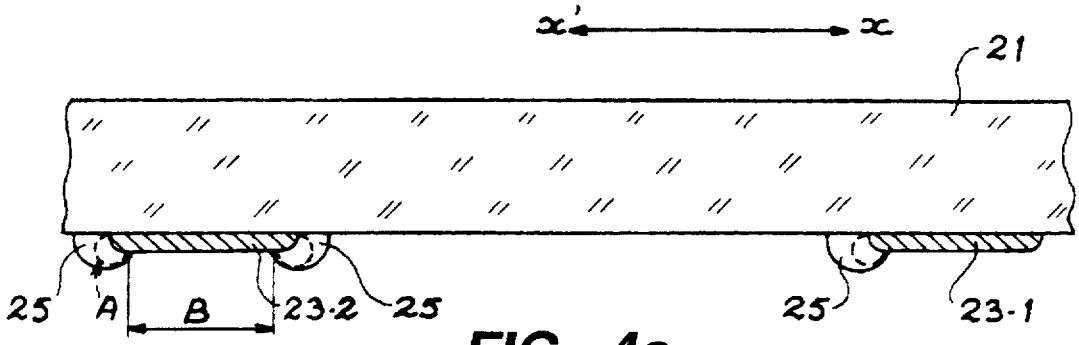
FIGS. 4*a* to 4*e* shows several possible structures of an electron collector according to the invention.
Figure 4B:
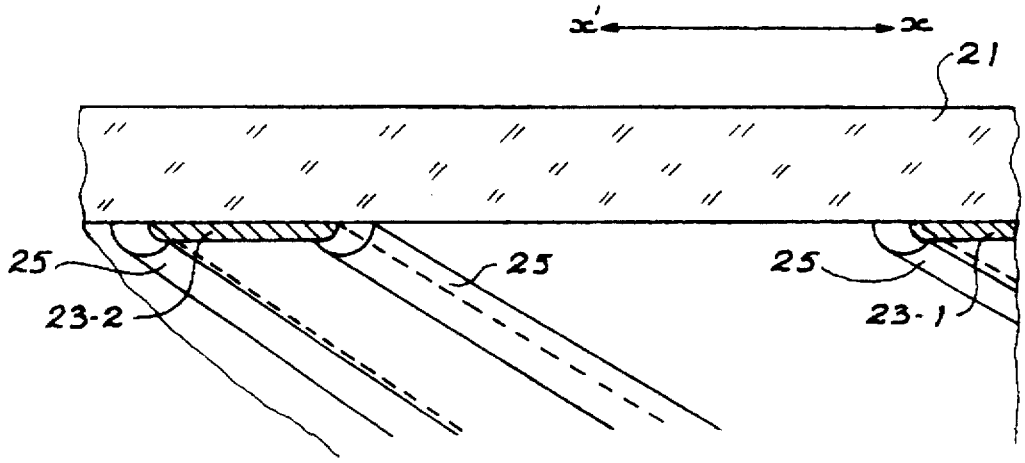

A preferred embodiment of an electron collector according to the invention is shown in section in FIG. 4*a* and in perspective in FIG. 4*b*. It will be appreciated that only part of the collector is shown, the pattern of FIGS. 4*a* and 4*b* being repeatable in an identical manner in direction x'x. The collector or anode has an insulating substrate 21, (e.g., of glass) extending in direction x'x and perpendicular to the plane of the drawing. The substrate supports conductive strips 23-1 and 23-2, also referred to as conductive tracks, which extend perpendicular to the plane of FIG. 4*a*. Each strip has a central portion (area B in FIG. 4*a*) defined by two edges (area A in FIG. 4*a*). Depending upon the application, one of ordinary skill in the art will be able to choose the dimensions of the substrate and the tracks. Typically, for an application to fluorescent screens, the substrate thickness is approximately 1 mm and the track thickness is approximately 1 micrometer or 0.1 micrometer. Tracks having a width of approximately 100 μm for a distance between two tracks of approximately 50 μm have already been produced.

Figure 4C:
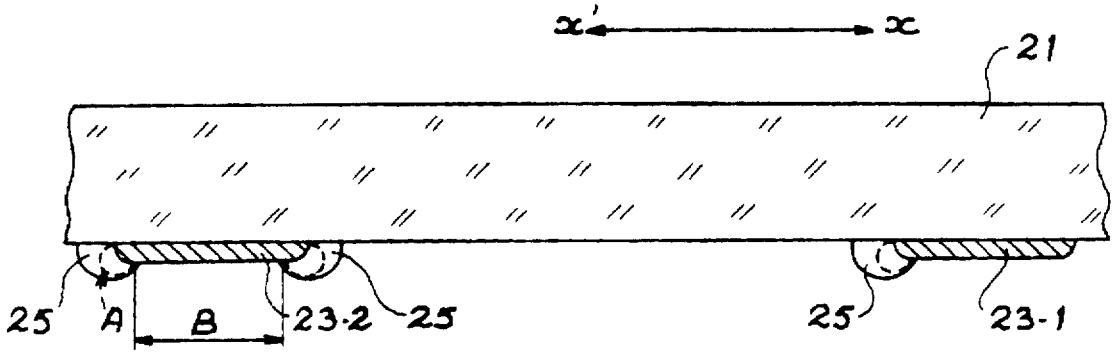

According to the invention, a dielectric material layer 25 is deposited on at least one of the edges of each track 23-1 and 23-2 and advantageously on each of the edges. In the case of the application to fluorescent screens, the luminescent materials are then deposited on the conductive tracks by any known process. The layer 25 extends in a direction perpendicular to the plane of FIG. 4*a* along the track on the edge of which it is deposited (as shown in FIG. 4*b*). It can also extend in accordance with x'x into the inter-track space and thus cover part of the space between two adjacent tracks, as illustrated in FIG. 4*a*. A variation is illustrated in FIG. 4*c*, which must also (as in FIGS. 4*d* and 4*e*) be understood as a sectional view of the electron collector, the substrate-track-dielectric layer system extending perpendicular to the plane of the drawing. In FIG. 4*c*, where the references 21, 23-1, 23-2 have the same meanings as in FIG. 4*a*, the dielectric material layer 27 covers the edges of the tracks 23-1 and 23-2, as well as all the space between them.

Figure 4D:
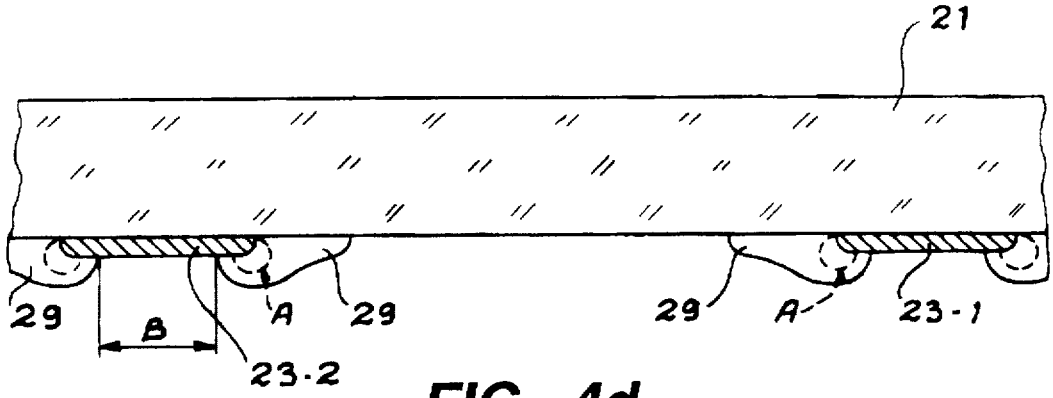

Another preferred embodiment of the invention is shown in FIG. 4*d*, where the dielectric material layer 29 extends beyond the edge of the track (23-1, 23-2) on which it is deposited and encroaches on the central portion thereof. However, this encroachment must be limited so as not to excessively reduce the surface covered by the luminescent materials (typically it is between one and a few microns).

Figure 4E:
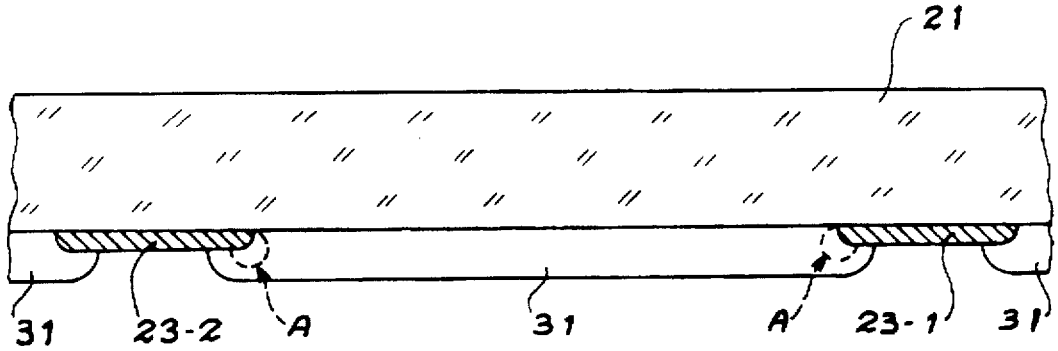

A variation is shown in FIG. 4*e*, where the dielectric material layer 31 extends over the space between the two tracks 23-1 and 23-2 and beyond the edge of each track in the direction of its central portion.

In all the cases described hereinbefore, if the material for the dielectric 25, 27, 29, 31 has a high dielectric constant, there is a reduction of the electric field on the edge of any conductive track 23-1, 23-2 in contact with the dielectric material (area A in FIGS. 4*a*, 4*c* to 4*e*) in a ratio equal to $\epsilon/\epsilon_o$, in which $\epsilon$ is the dielectric constant of the dielectric layer and $\epsilon_o$ the dielectric constant of the space. This reduces the breakdown risks by the same amount and therefore a higher voltage differential can be applied between the tracks 23-1 and 23-2. If silica is chosen as the dielectric material, $\epsilon/\epsilon_o \approx 4$. It would be more advantageous to work with $\epsilon/\epsilon_o \geqq 10$.

Moreover, as a result of the contact between the dielectric material layer and at least one edge of the corresponding track 23 and advantageously with both edges, the electrons emitted by the cathode will pass directly to the portion of the conductive track which is parallel to the substrate (area B in FIG. 4*a* or 4*c*) and the "edge" effect, i.e. the collection of electrons by the portion of the conductive track inclined towards the substrate, is considerably reduced. Thus, to some extent, there is an improvement of the focussing of the electrons onto the conductive track.

These two effects (reduction of the breakdown risk and better focussing) are reinforced when the dielectric layer projects slightly over the conductive tracks (FIGS. 4*e* and 4*d*).

Figure 5:
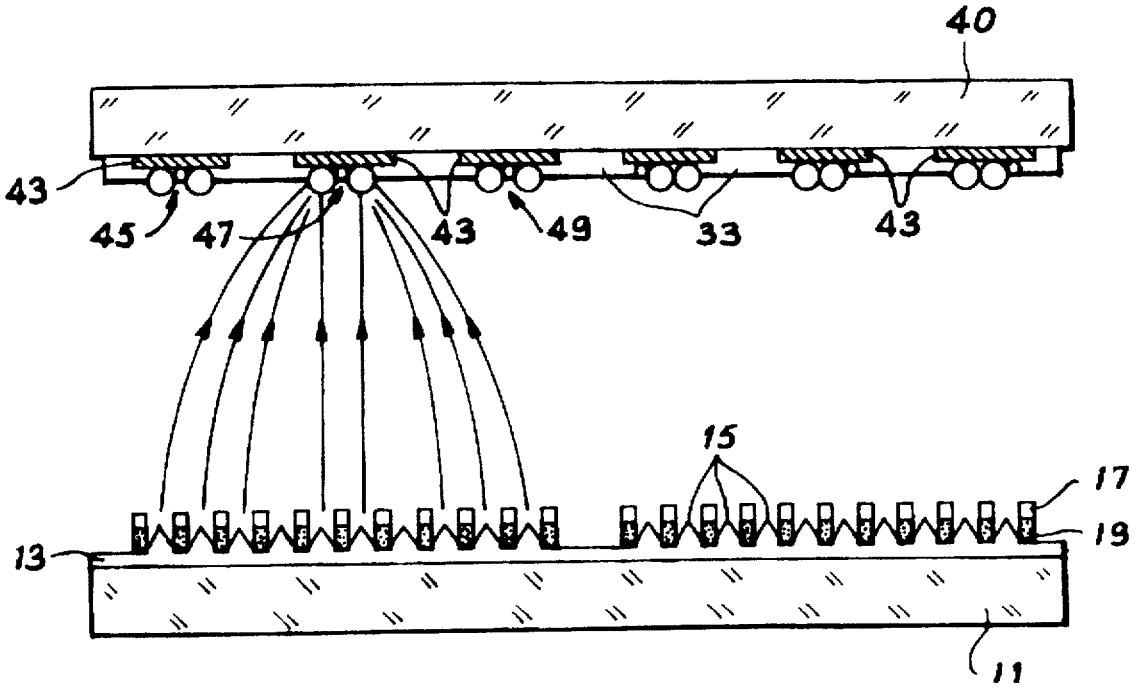
FIG. 5 shows the structure of an electron collector according to the invention incorporated into a microtip fluorescent screen.

In the illustrative case where the electron collector according to the invention is applied to a microtip fluorescent screen, the structure illustrated in FIG. 5 is obtained. FIG. 5 is a sectional view of the screen, which extends in direction x'x and perpendicular to the plane of the drawing. The screen is constituted by an anode and a cathode, the latter having the same structure as in the aforementioned prior art. The cathode has a first substrate 11, conductive columns 13 supporting metallic microtips 15 and intersecting perforated conductive rows 17 (grids). The columns and grids are separated by an insulating layer 19, e.g. of silica, provided with openings for the passage of the microtips 15. Advantageously, a resistive layer is intercalated between the microtips and the cathode conductors.

The anode has second insulating substrate 40, e.g. of glass, which supports conductive strips 43. Preferably, at least one of the two substrates (11) and (40) is transparent.

A first series of strips 43 is covered by a red-luminescing material 45, e.g. Eu-doped $Y_2O_2S$, a second series of strips 43 is covered by a green-luminescing material 47, e.g. CuAl-doped ZnS and the final series of strips 43 is covered by a blue-luminescing material 49, e.g. Ag-doped ZnS. Moreover, a dielectric material layer 33 is placed between the conductive strips 43 of the anode.

Preferably, dielectric layer 33 extends slightly beyond the edge of each conductive track 43 in the direction of the central portion of the latter (as illustrated in FIG. 4*d*).

FIG. 5 illustrates the focussing effect in the case of the microtip fluorescent screen. All the electrons emitted by the cathode pass to the luminescent material 47 of the selected track 43 and the luminous efficiency of the screen is improved.

Figure 6:
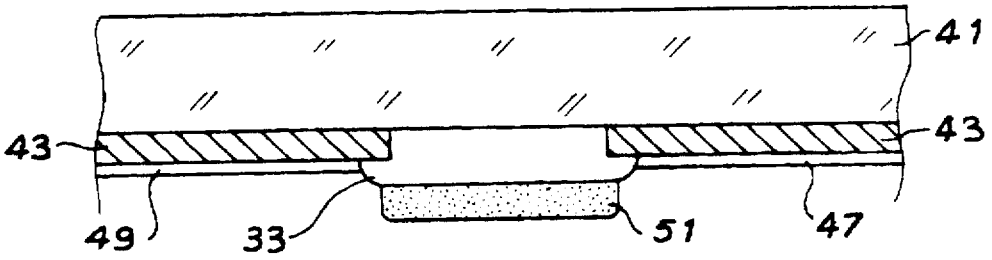
FIG. 6 shows an embodiment of a dielectric layer between two adjacent conductive strips of the anode of an electron collector according to the invention.

Once again in the case of the fluorescent screen and in order to improve contrast under external illumination, a reduced reflectivity of the anode can be obtained. This is obtained by choosing for the dielectric layer 33 a visible light-absorbing material. This can be useful for the application of the invention to displays. If the layer 33 is transparent, it will advantageously be covered by an absorbant material 51, as illustrated in FIG. 6. Material 51 is not necessarily an insulating material. FIG. 6 also shows two conductive tracks 43 and on each of them a luminescent material layer 47, 49.

Figure 7:
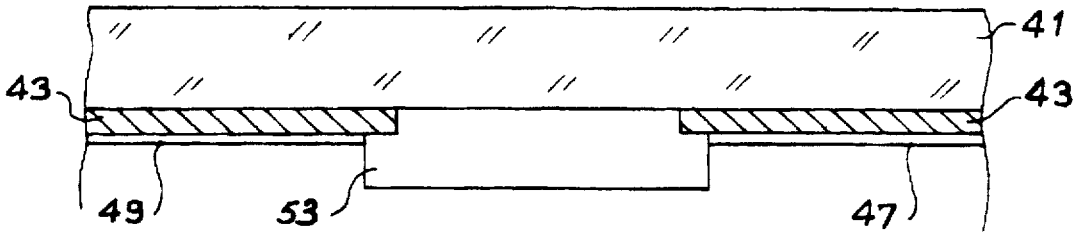
FIG. 7 shows an embodiment of a dielectric layer between two adjacent conductive strips of the anode of an electron conductor according to the invention.

Another embodiment of the dielectric layer is illustrated in FIG. 7. On the glass substrate 41 are deposited tin-doped indium oxide (ITO) conductive tracks 43, a luminescent material layer 47, 49 being deposited on each of the said tracks 43, whose thickness is approximately 0.2 μm.

The following procedure is used for forming the tracks. A tin-doped indium oxide layer is deposited, e.g. by cathodic sputtering. Parallel strips are then produced in the ITO layer using known methods, such as e.g. photolithography through a mask and chemical etching. In the latter case, it is possible to use a $FeCl_3$—HCl mixture at 50° C., the etching time under these conditions being approximately 2 minutes. The width of the strips and the distance between two strips are dependent on the desired application. For example, in the case of fluorescent screens, these parameters will be dependent on the desired resolution. For information purposes, strips having a width of 100 μm have been produced with an inter-strip distance of approximately 50 μm.

The dielectric layer 53 is made from silica and has a thickness of approximately 1 μm. The silica covers the ITO edges over a width of 10 um±5 μm (FIG. 7). The silica is e.g. deposited by chemical vapor deposition (CVD) on the entire surface. Its geometry is then defined using photolithography and chemical etching based on a mixture of HF and $NH_4F$. Luminescent materials can then be deposited on the conductive tracks by any known process.

According to an embodiment of the shield (same structure of the layers as in FIG. 7), the substrate 41 is of glass, the conductive tracks 43 of ITO or aluminium (Al). The process for forming the strips 43 is the same as that described hereinbefore. The dielectric layer 53 is of absorbant black glass with a low melting point. It is deposited by screen process printing on the entire surface and its thickness is approximately 5 μm. Its geometry is once again defined by photolithographic and chemical etching processes.

Figure 8:
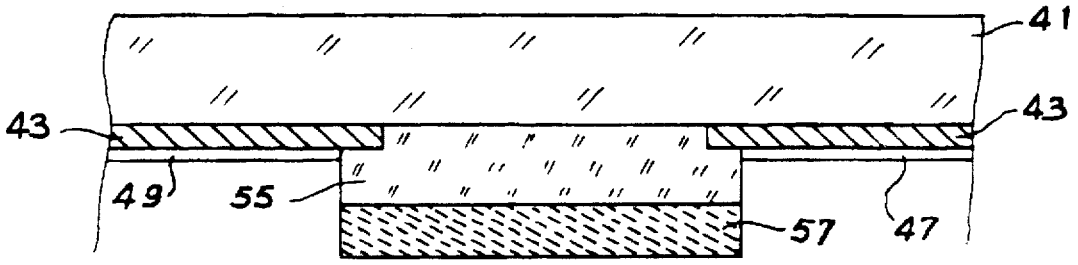
FIG. 8 shows another embodiment of a dielectric layer between two adjacent conductive strips of the anode of an electron collector according to the invention.

According to a third embodiment (FIG. 8), the substrate 41 is of glass, the conductive tracks 43 of ITO using the above formation process) and the dielectric layer 55 of silica with a thickness of approximately 1 μm. The layer 55 is covered by a black chromium dioxide layer 57 with a thickness of approximately 1 μm. The silica is first deposited by CVD on the complete surface and then a black chromium dioxide layer 57 is deposited on the silica, e.g. by cathodic sputtering. The oxide layer has a thickness of approximately 1 μm. Using lithography and chemical etching a pattern like that shown in FIG. 8 is then produced.

We claim:

1. An electron collector having an anode constituted by a substrate on which are deposited conductive strips each of which can be raised to a variable potential to bring them into a collecting or non-collecting state, each of the strips having a central portion defined by edges, wherein a dielectric material layer is deposited on at least one edge of each conductive strip, the dielectric material having a thickness of less than about 5 micrometers and a dielectric constant permitting, compared to a conductive strip on which no dielectric material is deposited, a reduction of an electric field at the at least one edge, the dielectric material layer also having visible light-absorbing properties.

2. The electron collector according to claim 1, wherein a dielectric material layer is deposited on each edge of each conductive strip, the dielectric material having a dielectric constant permitting, compared to a conductive strip on which no dielectric layer is deposited, a reduction of an electric field at each edge, the dielectric material layers also having visible light-absorbing properties.

3. The electron collector according to claim 1, wherein the dielectric material layer extends beyond the edge of the conductive strip on which it is deposited and encroaching on the central portion of the conductive strip.

4. The electron collector according to claim 1, the dielectric layer also extending from the edge of the conductive strip with which it is in contact to the edge of an adjacent conductive strip.

5. The electron collector according to claim 1, the dielectric material layer being of silica.

6. The electron collector according to claim 2, the dielectric material layer extending beyond the edge of the conductive strip on which it is deposited and encroaching on the central portion of said strip.

7. The electron collector according to claim 2, the dielectric material layer also extending from the edge of the strip with which it is in contact to the edge of the adjacent strip.

8. The electron collector of claim 1, wherein adjacent conductive strips are separated by a distance of approximately 50 μm.

9. The electron collector of claim 1, wherein the dielectric being deposited by chemical vapour deposition (CVD).

10. The electron collector of claim 1, wherein the dielectric material has a thickness of approximately 1 μm.

11. A microtip fluorescent screen assembly for a matrix display device, the screen assembly including an electron emitting cathode and an electron collector having an anode constituted by a substrate on which are deposited conductive strips each of which can be raised to a variable potential to bring them into a collecting or non-collecting state, each of the said strips having a central portion defined by edges, wherein a dielectric material layer is deposited on at least one edge of each conductive strip, the dielectric material having a thickness of less than about 5 micrometers and a dielectric constant permitting, compared to a conductive strip on which no dielectric material is deposited, a reduction of an electric field at the at least one edge, the dielectric material layers also having visible light-absorbing properties.

12. The microtip fluorescent screen of claim 11, wherein adjacent conductive strips are separated by a distance of approximately 50 μm.

13. The microtip fluorescent screen of claim 11, wherein the dielectric material layer extends beyond the edge of the conductive strip on which it is deposited and encroaching on the central portion of the conductive strip.

14. The microtip fluorescent screen of claim 11, wherein the dielectric layer also extending from the edge of the conductive strip with which it is in contact to the edge of an adjacent conductive strip.

15. The microtip fluorescent screen of claim 11, wherein the dielectric material layer being of silica.

16. The microtip fluorescent screen assembly of claim 11, wherein the dielectric material is deposited by chemical vapour deposition (CVD).

17. The microtip fluorescent screen assembly of claim 11, wherein the dielectric material has a thickness of approximately 1 μm.

18. A microtip fluorescent screen assembly for a matrix display device, the screen having an electron cathode and an electron collector having an anode constituted by a substrate on which are deposited conductive strips each of which can be raised to a variable potential to bring them into a collecting or non-collecting state, each of the strips having a central portion defined by edges, wherein a dielectric material layer is deposited on each edge of each conductive strip, the dielectric material having a thickness of less than about 5 micrometers and a dielectric constant permitting, compared to a conductive strip on which no dielectric material is deposited, a reduction of an electric field at the at least one edge, the dielectric material layers also having visible light-absorbing properties.

19. The microtip fluorescent screen of claim 18, wherein the dielectric material layer extends beyond the edge of the conductive strip on which it is deposited and encroaches on the central portion of said strip.

20. The microtip fluorescent screen of claim 18, wherein the dielectric material layer extends from the edge of the strip with which it is in contact to the edge of an adjacent strip.

21. An electron collector, comprising:

an anode constituted by a substrate on which are deposited conductive strips, defining interstrip spaces between them, each of which can be raised to a variable potential to bring it into a collecting or non-collecting state, each of the strips having a central portion defined by edges, wherein a dielectric material layer is deposited on at least one edge of each conductive strip, the dielectric material having a thickness of less than about 5 micrometers and a dielectric constant permitting, compared to the case where no dielectric material is deposited, a reduction of an electric field at the at least one edge, a free surface of said dielectric material opposite to the substrate having a reduced area compared to an area of the interstrip space.

22. The electron collector of claim 21, wherein the dielectric material does not extend into the interstrip space.

23. The electron collector of claim 21, wherein the dielectric material is partly covered by a visible light absorbing material.

24. The electron collector of claim 23, said visible light absorbing material being black chromium oxide.

25. The electron collector of claim 21, wherein the dielectric material is totally covered by a visible light absorbing material.

26. The electron collector of claim 21, wherein the dielectric material extends beyond the edge of the conductive strip on which it is deposited and encroaches on the central portion of the strip.

27. The electron collector of claim 21, wherein said dielectric material is deposited on each edge of each conductive strip, the dielectric material having a dielectric constant permitting, compared to a conductive strip on which no dielectric layer is deposited, a reduction of an electric field at each edge.

28. The electron collector of claim 21, wherein the dielectric material is of silica.

29. A microtip fluorescent screen assembly for a matrix display device, comprising:

an electron emitting cathode; and an electron collector having an anode constituted by a substrate on which are deposited conductive strips, defining interstrip spaces between them, each of which can be raised to a variable potential to bring them into a collecting or non-collecting state, each of the strips having a central portion defined by edges, wherein a dielectric material layer is deposited on at least one edge of each conductive strip, the dielectric material having a thickness of less than about 5 micrometers and a dielectric constant permitting, compared to a conductive strip on which no dielectric material is deposited, a reduction of an electric field at the at least one edge, a free surface of said dielectric material opposite to the substrate having a reduced area compared to an area of the interstrip space.

30. The microtip fluorescent screen assembly of claim 29, wherein the dielectric material does not extend into the interstrip space.

31. The microtip fluorescent screen assembly of claim 30, wherein the dielectric material is of silica.

32. The microtip fluorescent screen assembly of claim 29, wherein the dielectric material is partly covered by a visible light-absorbing material.

33. The microtip fluorescent screen assembly of claim 32, wherein the visible light absorbing material is black chromium oxide.

34. The microtip fluorescent screen assembly of claim 29, wherein the dielectric material is completely covered by a visible light-absorbent material.

35. The microtip fluorescent screen assembly of claim 29, wherein the dielectric material extends beyond the edge of the conductive strip on which it is deposited and encroaches on the central portion of the strip.

36. The microtip fluorescent screen assembly of claim 29, wherein the dielectric material is deposited on each edge of each conductive strip.

37. An electron collector, comprising:

an anode constituted by a substrate on which are deposited conductive strips each of which can be raised to a variable potential to bring it into a collecting or non-collecting state, each strip having a central portion defined by edges, wherein a dielectric material layer is deposited on at least one edge of each conductive strip, the dielectric material having a thickness of less than about 5 micrometers and a dielectric constant permitting, compared to the case where no dielectric material is deposited, a reduction of an electric field at the at least one edge.

38. The electron collector of claim 37, wherein a dielectric material layer is deposited on each edge of each conductive strip, each dielectric material layer having a dielectric constant permitting, compared to a conductive strip on which no dielectric layer is deposited, a reduction of an electric field at each edge.

39. The electron collector of claim 37, wherein the dielectric material layer extends beyond the edge of the conductive strip on which it is deposited and encroaches on the central portion of the conductive strip.

40. The electron collector of claim 37, wherein the dielectric layer also extends from the edge of the conductive strip with which it is in contact to the edge of an adjacent conductive strip.

41. The electron collector of claim 37, wherein the dielectric material is of silica.

42. The electron collector of claim 38, wherein the dielectric material layer extends beyond the edge of the conductive strip on which it is deposited and encroaches on the central portion of said strip.

43. The electron collector of claim 38, wherein the dielectric material layer also extends from the edge of the strip with which it is in contact to the edge of the adjacent strip.

44. The electron collector as in claim 37, wherein adjacent conductive strips are separated by a distance of approximately 50 μm.

45. The electron collector of claim 37, wherein the dielectric material layer has light-absorbing properties.

46. The electron collector of claim 37, wherein a visible light-absorbing material is deposited on the dielectric material layer.

47. The electron collector of claim 46, wherein the visible light-absorbing material being black chromium oxide.

48. The electron collector of claim 37, wherein the dielectric material layer is deposited by chemical vapour deposition (CVD).

49. A microtip fluorescent screen assembly for a matrix display device, comprising:

an electron emitting cathode; and an electron collector having an anode constituted by a substrate on which are deposited conductive strips each of which can be raised to a variable potential to bring them into a collecting or non-collecting state, each of the strips having a central portion defined by edges, wherein a dielectric material layer is deposited on at least one edge of each conductive strip, the dielectric material having a thickness of less than about 5 micrometers and having a dielectric constant permitting, compared to a conductive strip on which no dielectric material is deposited, a reduction of an electric field at the at least one edge.

50. The microtip fluorescent screen assembly of claim 49, wherein a dielectric material layer is deposited on each edge of each conductive strip, each dielectric material layer having a dielectric constant permitting, compared to conductive strip on which no dielectric material is deposited, a reduction of an electric field at the at least one edge.

51. The microtip fluorescent screen assembly of claim 50, wherein the dielectric material layer extends beyond the edge of the conductive strip on which it is deposited and encroaches on the central portion of said strip.

52. The microtip fluorescent screen assembly of claim 50, wherein the dielectric material layer also extends from the edge of the strip with which it is in contact to the edge of the adjacent strip.

53. The microtip fluorescent screen assembly of claim 49, wherein adjacent conductive strips are separated by a distance of approximately 50 μm.

54. The microtip fluorescent screen assembly of claim 49, wherein the dielectric material layer extends beyond the edge of the conductive strip on which it is deposited and encroaches on the central portion of the conductive strip.

55. The microtip fluorescent screen assembly of claim 49, wherein the dielectric layer also extending from the edge of the conductive strip with which it is in contact to the edge of an adjacent conductive strip.

56. The microtip fluorescent screen assembly of claim 49, wherein the dielectric material layer is of silica.

57. The microtip fluorescent screen assembly of claim 49, wherein the dielectric material layer has light-absorbing properties.

58. The microtip fluorescent screen assembly of claim 49, wherein a visible light-absorbing material is deposited on the dielectric material layer.

59. The microtip fluorescent screen assembly of claim 58, wherein the visible light-absorbing material is black chromium oxide.

60. The microtip fluorescent screen assembly of claim 49, wherein the dielectric material is deposited by chemical vapour deposition (CVD).

* * * * *